US007392733B1

(12) United States Patent
Kuklinski et al.

(10) Patent No.: US 7,392,733 B1
(45) Date of Patent: Jul. 1, 2008

(54) HIGH RESOLUTION PROJECTILE BASED TARGETING SYSTEM

(75) Inventors: Robert Kuklinski, Portsmouth, RI (US); Thomas J. Gieseke, Newport, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 395 days.

(21) Appl. No.: 10/947,789

(22) Filed: Sep. 20, 2004

(51) Int. Cl.
*F41F 3/10* (2006.01)
*F42B 15/20* (2006.01)

(52) U.S. Cl. ..... 89/5; 89/37.06; 42/1.14; 102/399

(58) Field of Classification Search ..... 102/346, 102/360, 399, 501; 42/1.14; 89/5, 37.06
See application file for complete search history.

(56) References Cited

U.S. PATENT DOCUMENTS

| | | | | | |
|---|---|---|---|---|---|
| 263,408 | A | * | 8/1882 | Hicks | 89/5 |
| 327,380 | A | * | 9/1885 | Chambers | 114/20.1 |
| 1,295,047 | A | * | 2/1919 | Louden | 102/399 |
| 2,998,769 | A | * | 9/1961 | Crist | 441/12 |
| 3,109,373 | A | * | 11/1963 | Saffer, Jr. | 102/399 |
| 3,205,822 | A | * | 9/1965 | Gustafsson et al. | 102/399 |
| 3,295,411 | A | * | 1/1967 | Lehmann | 89/1.81 |
| 3,323,457 | A | * | 6/1967 | Biehl et al. | 102/399 |
| 3,476,048 | A | * | 11/1969 | Barr et al. | 102/399 |
| 3,748,502 | A | * | 7/1973 | Bernstein | 310/319 |
| 3,787,741 | A | * | 1/1974 | Gourlay | 310/322 |
| 3,811,379 | A | * | 5/1974 | Sondheimer | 102/413 |
| 3,861,313 | A | * | 1/1975 | Campagnuolo et al. | 102/207 |
| 3,915,092 | A | * | 10/1975 | Monson et al. | 102/399 |
| 4,005,319 | A | * | 1/1977 | Nilsson et al. | 310/339 |
| 4,362,106 | A | * | 12/1982 | Campagnuolo et al. | 102/207 |
| 4,393,783 | A | * | 7/1983 | Goes et al. | 102/529 |
| 4,756,252 | A | * | 7/1988 | Melhus et al. | 102/374 |
| 5,078,069 | A | * | 1/1992 | August et al. | 114/20.1 |
| 5,481,505 | A | * | 1/1996 | Donald et al. | 367/130 |
| 5,929,370 | A | * | 7/1999 | Brown et al. | 102/399 |
| 6,305,263 | B1 | * | 10/2001 | Wallin | 89/5 |
| 6,405,653 | B1 | * | 6/2002 | Miskelly | 102/374 |
| 6,415,211 | B1 | * | 7/2002 | Kotlow | 701/35 |

FOREIGN PATENT DOCUMENTS

| | | | |
|---|---|---|---|
| GB | 2268251 | * | 1/1994 |

* cited by examiner

*Primary Examiner*—David J Parsley
(74) *Attorney, Agent, or Firm*—James M. Kasischke; Michael P. Stanley; Jean-Paul A. Nasser

(57) ABSTRACT

A projectile based targeting system for underwater objects includes a trainable gun terminal mounted in a waterproof housing. The gun terminal includes plural gun barrels terminating in waterproof breeches. Noise generating projectiles are launched from the gun barrels, and a fire control system selectively fires the projectiles from each of the plural gun barrels in a noise pattern. A host controller detects and processes noise generated by a launched pattern of the noise generating projectiles to give information about the objects. The projectiles each include a void region connected to an outer surface of the projectile by a hole formed in a neck of the projectile. Launching of the projectile creates a vaporous cavity around the projectile and thus the hole, thereby causing the void region to resonate at a noise generating frequency.

9 Claims, 3 Drawing Sheets

HIGH RESOLUTION PROJECTILE BASED TARGETING SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

This invention generally relates to a system and apparatus to identify a position and near instantaneous track of an underwater object moving at any subsonic speed.

More particularly, the invention relates to a system and apparatus as described in which the position of the underwater object is determined by a reflection of a radiated sound field from at least one projectile interacting with the underwater object. The system consists of a multi-barreled gun that discharges a multiplicity of projectiles in a predetermined time sequence and/or pattern. The projectiles themselves are designed to travel at a significant range and are modified to produce a high amplitude narrow frequency radiated noise. The entire system is coupled with a sonar tracking system and a trainable launcher. The preferred embodiment is described in connection with a submarine based gun and targeting system.

(2) Description of the Prior Art

The prior art for underwater targeting systems rely on the projection of an active sonar pulse or "ping" P1 and the received return signal RP1 from a target 90 such as that shown in FIG. 1A. The return signal RP1 is processed to determine the location of the underwater target 90. In the system of FIG. 1A, the sound ping P1 leaves an acoustic transmitter T1. The underwater object 90 is located at a distance d from a platform 92. The ping P1 as reflected off the target 90 becomes reflected ping RP1, travels an approximate distance d back toward the platform 92 and is intercepted by a sonar receiver S1. The information from the sonar receiver S1 is processed. A command is sent to a sonar array (not shown) to transmit a new ping P2. Ideally, the new ping P2 is directed in the relative direction of travel of the underwater object 90 and the platform 92. The time delay in this system is (2*d/c) where c is the sound speed of the environment. The determination of the location of the underwater object depends on the ability to transmit, receive and process the sonar information. The signal processing in general is more effective when high relative Doppler shift exists between the underwater object 90 and the background acoustic environment and the propagation distance is minimized. This system has been used successfully for target tracking and underwater imaging since World War II. The processing of the return signal RP1 may be complicated by a number of factors such as bending of acoustic waves in thermal or salinity gradients, multiple target reflection and the like. For torpedo defense application, both precise instantaneous target position and estimate of target track are critical to system performance. The system performance could be greatly improved with a more accurate tracking system.

Another known solution to the targeting problem is shown in FIG. 1B. In the device of FIG. 1B, the ping P1 is replaced by a projectile path P(path). The projectile P travels toward the underwater object 90 at high speeds and ideally would travel just below sonic speed. The projectile P is assumed to be a compact noise source. As the projectile P approaches the target 90, the radiated noise from the projectile P at point p will interact with the object 90. The amplitude of the reflected sound will be a function of both the amplitude of the projectile's radiated sound and the miss distance $M_d$. This reflected sound S1 then travels back to the platform 92 and is processed. This system yields more accurate information than the system of FIG. 1A because the position of the projectile P in space is known. The high rate of change in the Doppler return as the projectile P approaches and then passes the target 90 allows calculation of the miss distance. The processing of data in the FIG. 1B system relies on the knowledge of projectile position (this is a known quantity with an error associated with projectile dispersion) and sufficient signal to noise ratio and a prior understanding of the spectrum of the radiated noise of the projectile. The prior art does not teach an ideal projectile for this use.

Another concern for overall targeting is the determination of the object track. In general, three to five separate pings of data are required to determine the track of object 90. FIG. 2 shows that for either of the known approaches in FIG. 1A and FIG. 1B, the target 90 will change position during the time between the transmission of the first ping or projectile and the processing of the fourth return. The distance the object migrates (Tmd) during that time in comparison to the initial standoff distance d is an important source of error in the understanding of the object's true position and track. The prior art does not address this problem.

The following patents, for example, disclose object detection systems, but do not disclose the determination of a position of an underwater object by reflection of a radiated sound field pattern from projectiles interacting with the underwater object.

U.S. Pat. No. 4,350,881 to Knight et al.;

U.S. Pat. No. 5,062,641 to Poillon et al.;

U.S. Pat. No. 5,481,505 to Donald et al.;

U.S. Pat. No. 5,614,657 to Harada;

U.S. Pat. No. 5,929,370 to Brown et al.; and

U.S. Pat. No. 6,405,653 to Miskelly.

Specifically, Knight et al. disclose an apparatus for indicating the location in a measurement plane through which a projectile passes. The apparatus includes an array of at least three transducers responsive to the airborne pressure wave produced by the projectile and positioned at predetermined locations along a line parallel to the movement plane. The apparatus further includes a device for measuring the velocity of the projectile and another for measuring the velocity of sound in air in the vicinity of the transducers. A computing means, responsive to the array of transducers, the velocity measuring means and the propagation of sound determination is provided which determines the location in the measurement plane through which the projectile passed and provides an output indicating that location. Also disclosed is a means, in combination with the position detecting means, for detecting and providing a positive indication of a projectile hit on a target member.

The patent to Poillon et al. discloses a system that accurately determines the location of the point of impact of a projectile, such as a golf ball, on a screen. A timer is provided that is activated when the projectile leaves a start point positioned at a known location. Upon impact of the projectile on the screen, a sound wave is produced that travels to a plurality of sound wave detectors. The system measures the time the sound wave travels to the plurality of sound wave detectors. These travel times are utilized to determine the point of impact of the projectile on the screen. The point of impact and flight travel time is used to determine the trajectory and velocity of the projectile. These parameters are then used to determine the distance the projectile would have traveled if unimpeded.

Donald et al. disclose a method and apparatus for detecting, processing and tracking sonar signals to provide bearing, range and depth information that locates an object in three-dimensional underwater space. An inverse beamformer utilizes signals from a towed horizontal array of hydrophones to estimate a bearing to a possible object. A matched field processor receives measured covariance matrix data based upon signals from the hydrophones and signals from a propagation model. An eight nearest neighbor peak picker provides plane wave peaks in response to output beam levels from the matched peaks within the specified limit of frequency, bearing change over time, range and depth to specify an object as a target and to display its relative range and depth with respect to the array of hydrophones.

Harada discloses a three dimensional measuring apparatus including a gun, a pedestal for the gun, three microphones, a pedestal of a product and a data processor. The gun shoots very small bullets at a target such as a casting product. The very small bullets explode or rupture and generate high frequency sound at the time of hitting against the target. The three microphones catch the high frequency sounds. All these sound data are gathered to the data processor, and processed into three-dimensional data of the surface of the product.

The patent to Brown et al. discloses a projectile propelled from a location in air, through an air/water interface, and toward a submerged underwater object. The projectile includes a forward end that forms a cavitation void around the projectile in water, avoiding water drag on the remainder of the projectile. The projectile further includes an outwardly flared or finned rearward end that aerodynamically stabilizes the projectile in air and flare stabilizes it in water, in each case against yaw.

Miskelly discloses a supercavitating underwater projectile adapted to be fired from a gun or the like, comprising a front end or nose portion and a rear end portion. An auxiliary rocket motor is disposed within the rear end portion of the projectile for providing additional thrust after the projectile has been fired. Vents are disposed within the projectile and are in communication with the rocket motor and the exterior of the projectile for venting some of the combustion gases from the rocket motor to the exterior of the projectile near the nose portion thereof to increase the size of the cavitation bubble formed as the projectile travels through the water and thereby reduce hydrodynamic drag on the projectile.

It should be understood that the present invention would in fact enhance the functionality of the above patents by providing better resolution of the position of underwater objects, improved determination of the track of an underwater object, the ability to more effectively target underwater objects moving at high speed, better resolution of underwater objects and tracks in poor acoustic environments, decreased signal processing requirements to achieve a desired target resolution, and better ability to resolve multiple targets.

SUMMARY OF THE INVENTION

Therefore it is an object of this invention to provide a system for determining a nearly instantaneous track of an underwater object.

Another object of this invention is to provide a means to control a spectrum of radiated noise and amplitude from a projectile.

Still another object of this invention is to provide a system for accurately determining an instantaneous position of an underwater object.

A still further object of the invention is to provide a targeting system that minimizes effects of single projectile dispersion.

In accordance with one aspect of this invention, there is provided a projectile based targeting system for underwater objects, the system including a trainable gun terminal mounted in a waterproof housing, the gun terminal including plural waterproof breeches. Plural gun barrels are formed in a muzzle of the gun terminal, each of the plural gun barrels terminating in the waterproof breeches of the gun terminal. Noise generating projectiles are launched from the gun barrels by a fire control system which selectively fires the projectiles from each of the plural gun barrels in a noise pattern. A host controller detects and processes noise generated by a launched pattern of the noise generating projectiles. The projectiles each include a void region connected to an outer surface of the projectile by a passage formed in the projectile. Launching of the projectile creates a flowing vaporous cavity around the projectile and thus the passage, thereby causing the void region to resonate at a noise generating frequency.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF THE PREFERRED EMBODIMENT

In general, the present invention is directed to a high resolution projectile based targeting system. More specifically, and referring first to FIG. 3 of the present invention, there is shown a gun system 10 used in the novel projectile targeting system of the present invention.

Figure 1A:
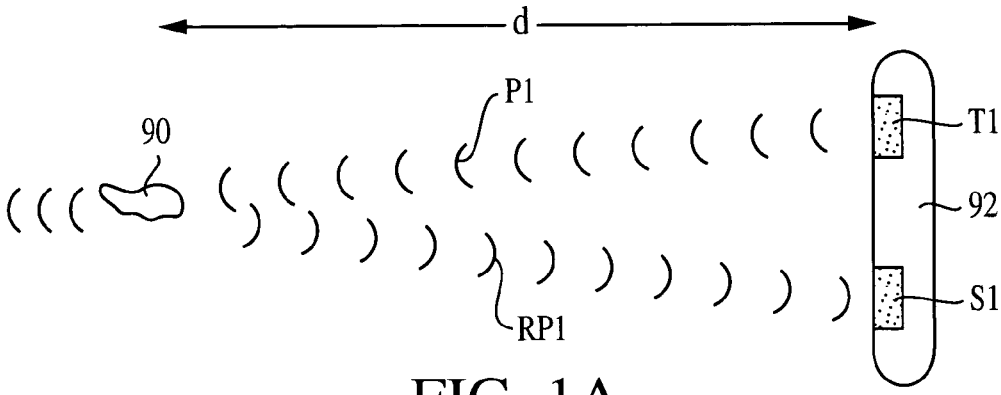
FIG. 1A (PRIOR ART)
FIG. 1A is a view of a traditional underwater targeting system.
Figure 1B:
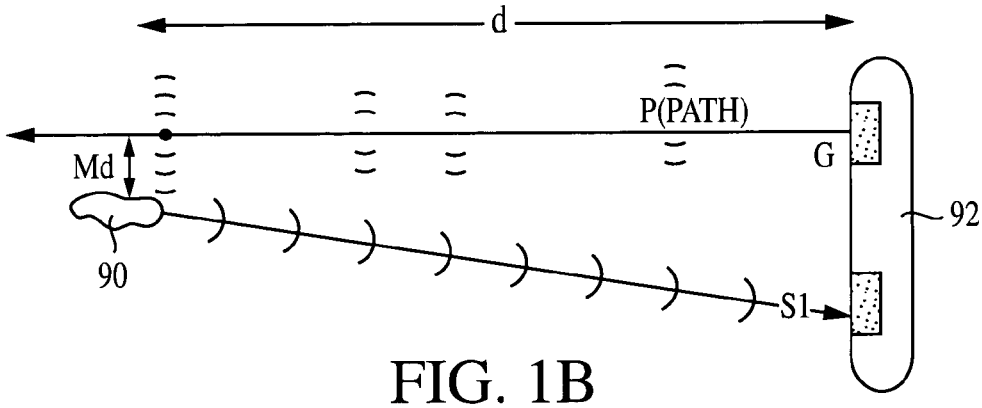
FIG. 1B (PRIOR ART)
FIG. 1B is a view of another known underwater targeting system.
Figure 2:
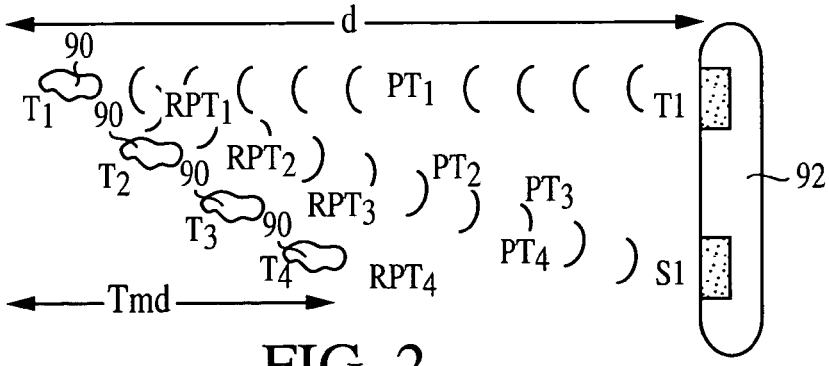
FIG. 2 shows a change in target position over time for each of the systems shown in FIGS. 1A and 1B.
Figure 3:
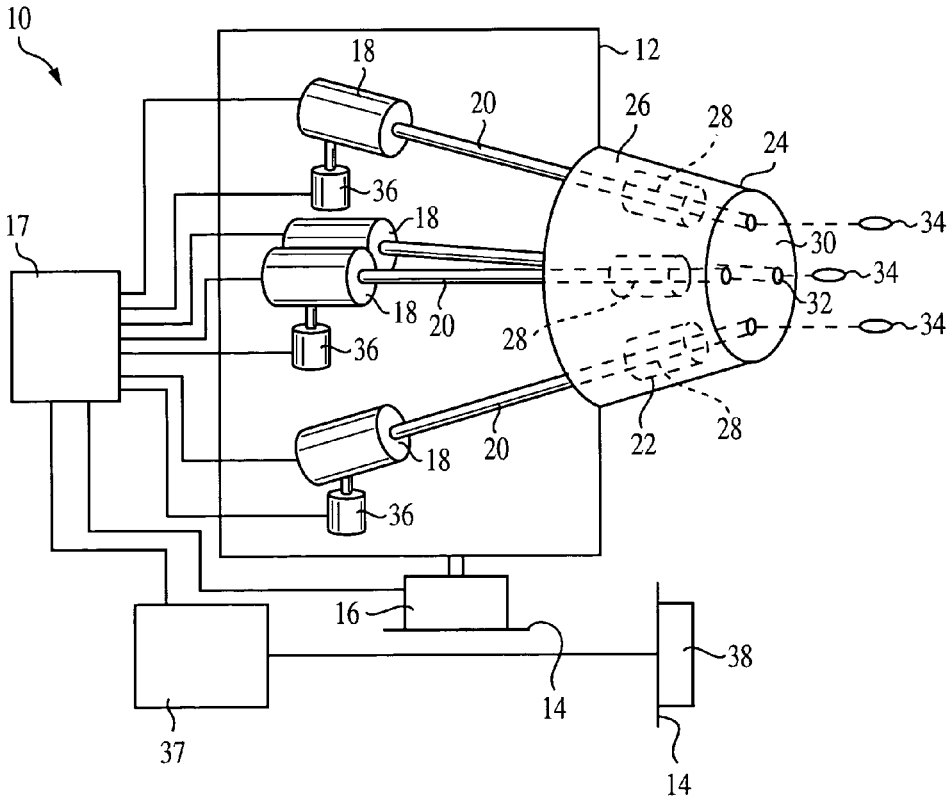
FIG. 3 is a schematic view of a preferred embodiment of the present invention.

FIG. 3 shows a gun system 10 of the current invention. In system 10, a gun terminal 12 is joined to an underwater platform 14 by a trainable mounting fixture 16. A fire control system 17 is joined to trainable mounting fixture 16 and to a breech 18 associated with each gun. A gun barrel 20 is joined at its proximate end to each breech 18. The distal end of each gun barrel 20 is joined to a muzzle assembly 22. Muzzle assembly 22 includes a housing 24 having a gas deceleration area 26 defined therein. A sabot separator 28 associated with each gun is also located within deceleration area 26. The forward face 30 of muzzle assembly 22 has sealable apertures 32 formed therein for each gun. Muzzle assembly 22 can be similar to the muzzle assembly disclosed in U.S. Pat. No. 5,966,858 to Curtis et al. which is incorporated herein by reference.

In a preferred embodiment, each gun barrel 20, breech 18 and sabot separator 28 is mounted to pivot about the associated sealable aperture 32 within muzzle assembly 22 and mounting fixture 16. This allows firing of projectiles 34 at a selectable angular position. Angular positioning of each gun barrel 20 can be obtained by use of an actuator 36 joined to each gun. Actuators 36 are joined to fire control system 17 for control of positioning for each barrel 20. Large positioning adjustments for the entire gun terminal can be made by using trainable mounting fixture 16.

Fire control system 17 is joined to an acoustic targeting system 37. Acoustic targeting system 37 is joined to a transducer 38 in acoustic contact with the surrounding environmental water. Transducer 38 receives acoustic signals from the surrounding water and transmits them to acoustic targeting system 37. Acoustic targeting system 37 performs computations on the received signals and transmits targeting data to fire control system 17. These computations can be performed utilizing the position of the launched projectiles and analysis of the received reverberation. The position of the launched projectiles can be determined by knowledge of the projectile launch directions and times, by analysis of the received noise generated by the projectile or by a combination of these methods. Analysis of the received noise and reverberation utilizes the frequency of the original signal and Doppler shift of the received reverberation to give the position and path of target by means known in the art.

Figure 4A:
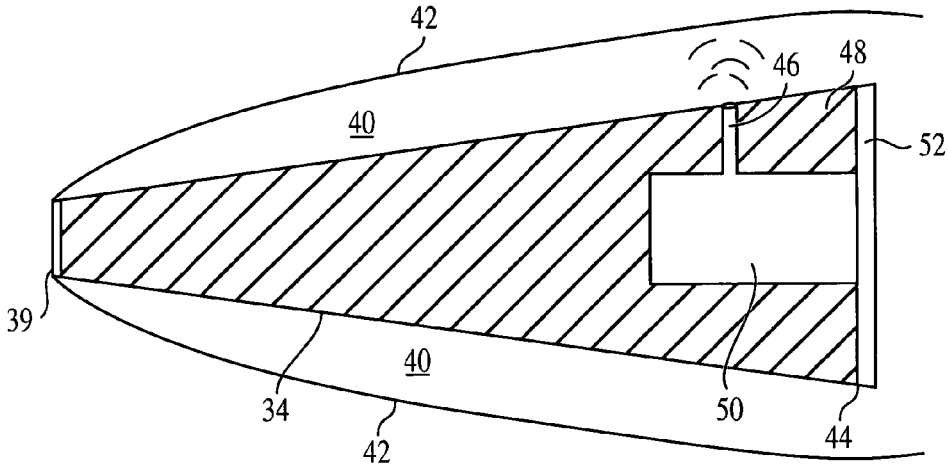
FIG. 4A is a side view of a projectile of the present invention.
Figure 4B:
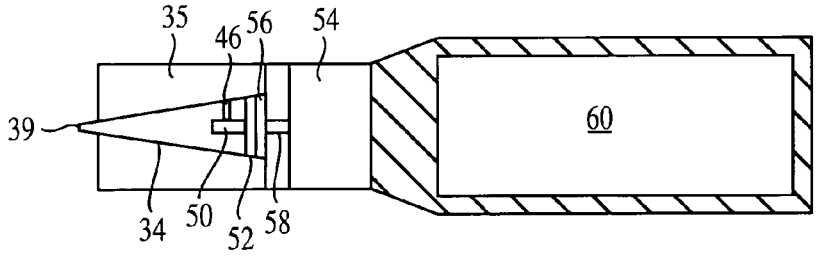
FIG. 4B is a side view of the projectile of FIG. 4A in a projectile package.

The projectile package is shown in detail in FIG. 4B and includes a projectile 34 in a sabot package 35. The sabot package 35 is separated from the projectile 34 in the gas decelerator area 26. The sabot petals could cause interference with neighboring projectiles and as such the projectiles 34 are fired with a minimum time delay such that each sequential projectile 34 clears the gas decelerator area 26 before the next projectile passes through the gas decelerator area 26.

The discharged projectiles 34 will enter water outside of a flooded section (not shown) of the platform 14 with a slight delay (on the order of the distance of the void/gas decelerator area 26). This delay can be increased to any desired length and typically will spread projectiles out at five meter intervals.

The actuators 36 are used to change a dispersion pattern of the projectiles 34 fired from the system 10. A wide or narrow projectile pattern or any combination therebetween may be used. The cutout shapes of the sealable apertures 32 in the muzzle face 30 of the gas decelerator 26 accommodate this range of motion.

FIG. 4A shows the noisy projectile 34 in further detail. The preferred embodiment of a projectile 34 is a high speed, near sonic design shown in FIG. 4A. A tip 39 of the projectile 34 in conjunction with high-speed travel in fluid generates a vaporous cavity 40 and a cavity boundary 42 around the projectile 34. The dimensions of a typical projectile 34 are about 5.2" in overall length, 0.516" diameter for a base 44, and 0.067" for the tip 39. The ratio of the projectile base 44 is much larger than the projectile tip 39. Typically a 15 to 1 or 10 to 1 ratio in the base 44 and cavitator tip 39 dimensions are used.

A small, machined passage 46 is formed through a neck region 48 of the projectile 34 and, in this case, has a length approximately one fourth of the base diameter. The passage 46 is connected to a relatively large void region 50. In this case, the void region 50 is a right cylindrical section having a length of 1.5" and a radius of one half the base diameter. The void region 50 terminates in a solid end cap 52. In a typical projectile package (shown in FIG. 4B), effects of a pusher 54 and coupler 56 exert high local force on the projectile base 44 thus necessitating separation between the void region 50 and the base 44. Water vapor flowing through the cavity 40 causes the passage 46 and enclosed void 50 to act as a Helmholtz resonator. This produces a high amplitude noise source in the cavity 40 over a narrow frequency range. The amplitude of the noise is sufficient that transmitted noise through the cavity boundary 42 still produces a high radiated noise in fluid at a substantially single frequency.

The size of the passage 46 used will change the frequency of the noise. If the projectile 34 slows below supercavitation speed, fluid will flow directly over the cavity 40 and still produce a high amplitude noise.

Figure 4C:
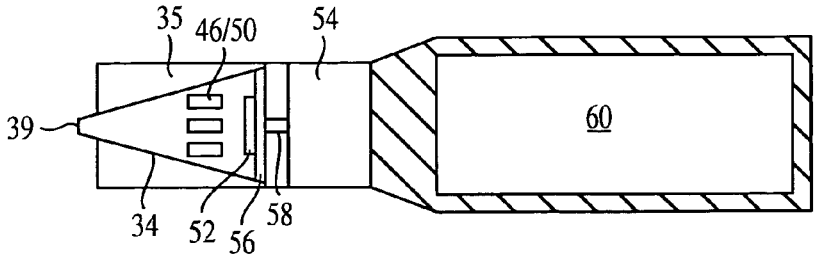
FIG. 4C is an alternative projectile shown in a projectile package according to the present invention.

FIG. 4C shows a low speed projectile design. In this case the base 44 may be nearly as wide as the gun barrel. Thus, the volume of the projectile 34 would be much larger. In this case a number of resonant voids 50 and passages 46 may be present in a single projectile. The passages 46 or the voids 50 need not be of the same size and in some applications it may be desirable that they are not. The projectile end cap 52 contains a nozzle 58 that is connected to a solid rocket propellant 60 that is used to extend the range of the projectile 34. This design may also be used in wetted or supercavitation modes of travel.

Alternatives to the system and devices as described are understood to be included within the scope of the invention. Some alternatives are mounting of the gun system 10 on a separate platform, such as an autonomous UUV, from the sonar receiver/host controller. Any number of gun barrels could be used. The gun system 10 could be used in combination with an existing active sonar system. Devices with alternative mechanical/electronic means to produce sound could be built into the projectile. The "noisy" projectiles could be fired from a Gatling gun (analogous to tracer bullets) in addition to standard projectiles to provide a near continuous closed loop targeting system. The projectiles may be designed with any number and size of enclosed volumes and any aperture pattern to produce any desired frequency of radiated noise or multiple frequencies of radiated noise in a single projectile.

In view of the above detailed description, it is anticipated that the invention herein will have far reaching application other than those of an underwater projectile targeting system.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed is:

1. A targeting system for an underwater object comprising:

a gun terminal;

at least one gun barrel positioned in said gun terminal, each gun barrel terminating in a waterproof breech;

at least one noise generating projectile launchable from said at least one gun barrel, said noise generating projectile comprising a bullet having at least one cavity formed therein, the cavity being formed to create a noise at a predetermined frequency in response to fluid flow over the bullet after launch of said noise generating projectile;

a fire control system joined to selectively fire said at least one noise generating projectile from said at least one gun barrel;

a transducer joined to receive environmental acoustic signals including noise generated by said noise generating projectile and reverberations of noise generated by said noise generating projectile; and an active sonar processor joined to said transducer for processing received environmental acoustic signals to determine the location of the object causing reverberation.

2. The system according to claim 1 wherein:

said at least one noise generating projectile comprises multiple projectiles; and said at least one gun barrel comprises multiple gun barrels arranged in said gun terminal and capable of firing multiple noise generating projectiles in a firing pattern.

3. The system according to claim 2 further comprising a barrel actuator joined to each of said multiple gun barrels for positioning said gun barrels to adjust the firing pattern.

4. The system according to claim 3 further comprising a gun terminal actuator joined to said gun terminal for aiming said gun terminal toward an area of interest.

5. The system according to claim 1 wherein said at least one noise generating projectile further comprises:

a cavitator positioned at a forward end of said bullet for generating a vapor cavity about said bullet after launch; and a sabot positioned about said bullet and separable from said bullet during launch.

6. The system according to claim 5 further comprising a sabot separator positioned on each at least one gun barrel near the waterproof breech.

7. The system according to claim 1 wherein the bullet has multiple cavities formed therein capable of creating noise at multiple predetermined frequencies.

8. The system of claim 1 wherein said cavity in said bullet is capable of acting as a Helmholtz resonator when fluid flows over said cavity.

9. The system of claim 8 wherein said cavity in said bullet has a passage in communication with environmental fluid and a void in communication with said passage, said void being otherwise sealed.

* * * * *